United States Patent [19]

Tardy

[11] 4,261,164

[45] Apr. 14, 1981

[54] DOUBLE TWIST SPINDLES

[75] Inventor: Jean-Jacques Tardy, Caluire, France

[73] Assignee: Verdol S.A., Caluire, France

[21] Appl. No.: 55,576

[22] Filed: Jul. 9, 1979

[30] Foreign Application Priority Data

Jul. 12, 1978 [FR] France ..... 78 21603

[51] Int. Cl.[3] ..... D01H 1/10; D01H 7/86

[52] U.S. Cl. ..... 57/58.76

[58] Field of Search ..... 57/58.72–58.81

[56] References Cited

U.S. PATENT DOCUMENTS

| | | | |
|---|---|---|---|
| 2,233,645 | 3/1941 | Smith | 57/58.7 C |
| 2,534,496 | 12/1950 | Agresti | 57/58.7 C X |
| 2,563,641 | 8/1951 | Colombu et al. | 57/58.7 C X |
| 2,575,476 | 11/1951 | Truitt | 57/58.7 C X |
| 2,684,566 | 7/1954 | Roberts | 57/58.7 C |

*Primary Examiner*—John Petrakes

*Attorney, Agent, or Firm*—Dowell & Dowell

[57] ABSTRACT

In a double twist spindle device wherein the support of the supply bobbin is retained against rotation on the spindle proper by two rows of permanent magnets disposed opposite each other each side of the radial passage of the yarn issuing from the axial bore of the spindle, one of the said rows is mounted in such manner as to be displaceable through a limited extent with respect to its supporting member. If the frictional torque between the spindle and the bobbin support temporarily reaches such an excessive value that the relative angular displacement of the rows becomes equal to the pitch of the successive magnets in both rows, the repulsive magnetic forces displace the said displaceable row in such manner that the undesirable accelerating effect of the magnetic forces on the bobbin support is eliminated or at least strongly decreased and that the rows may again find a new state of equilibrium when the excessive frictional torque disappears. In an embodiment the row corresponding to the bobbin support is angularly displaceable through an angle greater than the pitch of the magnets in the rows. In another embodiment it is displaceable axially so as to momentarily increase the distance apart of both rows.

7 Claims, 4 Drawing Figures

DOUBLE TWIST SPINDLES

The present invention relates to double twist spindle devices wherein the supply bobbin is maintained stationary on the rotating spindle, the yarn from the said bobbin passing downwardly through the hollow spindle and issuing radially therefrom below the bobbin to form a balloon which rotates around the latter before passing through an upper thread-guide disposed axially above the device.

The problem which is encountered in such devices is that the bobbin supporting plate, which is rotatably mounted on the spindle, should be retained against rotation during operation while, owing to the presence of the balloon which rotates starting from the spindle proper, thus fully surrounding the plate-and-bobbin unit, no physical connecting member may be directly provided for this purpose. A number of means have been proposed to realize such a connection through the space required for passage of the rotating yarn, the most generally used being formed of permanent magnets, carried by the bobbin supporting plate and by a fixed retaining member disposed at a small distance from the latter.

The disadvantage of this known arrangement is that if for any reason the angular displacement of the bobbin supporting plate with respect to the retaining member exceeds a predetermined limit even during a very short time, the retaining torque reverses and therefore the plate accelerates and begins rotating with the spindle. Considering for instance the case of two circular rows of permanent magnets of alternate polarity, the angular limit is equal to the angular spacing apart of the magnets in the rows. In actual practice such an excessive angular displacement of the bobbin supporting plate may result for instance from a momentary increase of the frictional forces which appear between the yarn and the periphery of the bobbin from which it unwinds, from the presence of a fibrous particle in the ball bearings interposed between the bobbin supporting plate and the spindle, etc... In order to avoid as far as possible such rotation of the bobbin it is therefore necessary to provide abnormally strong magnets and to dispose the two rows quite close to each other, thus decreasing the space available for the outlet disc from which the yarn issues through a radial perforation connected to the spindle bore.

It is an object of the present invention to reduce the risk of rotation of the bobbin supporting plate without having to rely on an increase of the magnetic forces which appear between the two rows of magnets.

In accordance with the invention the magnets of one row are automatically displaced in order to reduce their repulsive action on magnets of the same polarity of the other row when they come close to them.

Theoritically speaking a magnet has two poles, but in the case of two rows of magnets facing each other the attractive or repulsive action exerted by a magnet of one row mainly results from the pole which faces the other row. Furthermore the magnets may be mounted on a common armature which fully syppresses the action of the other pole. It may thus be said that a magnet is North and the next one South, and so on. Considering now a North magnet of the upper row (the row carried by the bobbin supporting plate), if the frictional torque exerted by the rotating spindle on the bobbin supporting plate (through the bearings or through the yarn) is of negligible importance this magnet will be just in front of a South magnet A of the lower row (the row carried by the retaining member), this magnet A being situated in the said row between two North magnets B and C. Magnets M and A being in front of each other, their mutual attractive force is directed longitudinally and has no horizontal resultant tending to rotate the plate. As to magnets B and C, they exert on magnet M equal and opposed horizontal resultants. The bobbin supporting plate is therefore in a state of angular equilibrium.

If now a noticeable frictional torque appears between the spindle and the bobbin supporting plate, the upper row tends to rotate with the said plate, but as soon as magnet M begins being angularly displaced, the attractive force between M and A generates a horizontal resultant which tends to retard rotation of the plate. Also if magnet M of the upper row moves for instance towards magnet B of the lower row, the repulsive action of B increases and the repulsive action of C decreases. If therefore the frictional torque is not excessive a state of equilibrium is again reached with a limited angular displacement of the bobbin supporting plate in the direction of rotation of the spindle.

But if the frictional torque becomes such that magnet M comes in front of magnet B, the repulsive force exerted by B has no more any horizontal resultant while the attractive force exerted by A has decreased and is moreover balanced by the attractive force exerted by the next magnet of the lower row situated beyond magnet B in the direction of rotation of the spindle. The bobbin supporting plate may thus freely go on rotating and it is easy to understand that as soon has it has passed beyond magnet A, the magnetic forces reverse, which means that they tend to accelerate the plate which finally rotates with the spindle, the device then acting as a conventional single twist spindle.

But if as provided by the present invention, means are provided to decrease the repulsive action between M and B when they come close to each other, the undesirable accelerating effect above referred to is avoided and as soon as the excessive torque has disappeared, the bobbin supporting plate again finds a position of equilibrium instead of continuing its rotation.

Figure 3:
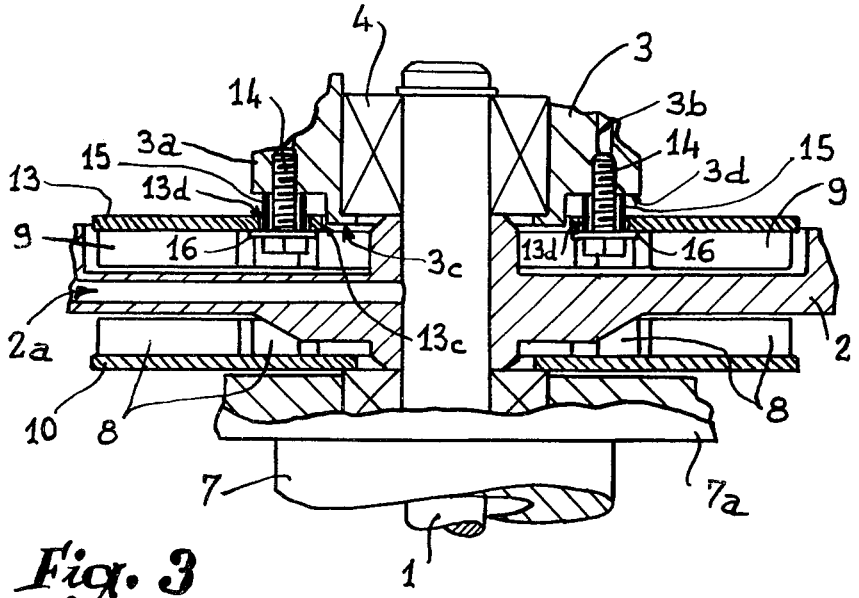
FIG. 3 illustrates in longitudinal section a second embodiment of the invention.
Figure 4:
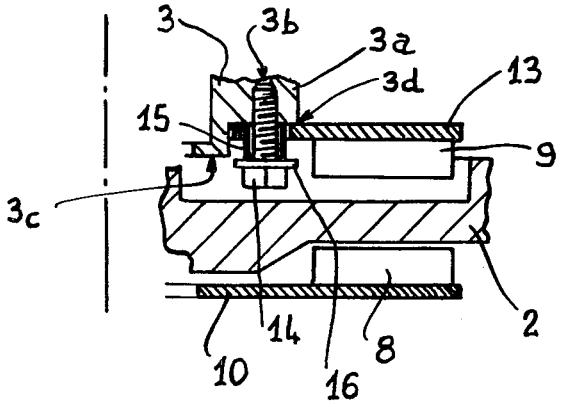

FIG. 4 reproduces a portion of FIG. 3 assuming that the upper row of magnets has been raised by the vertical resultant of the repulsive magnetic forces.

Figure 1:
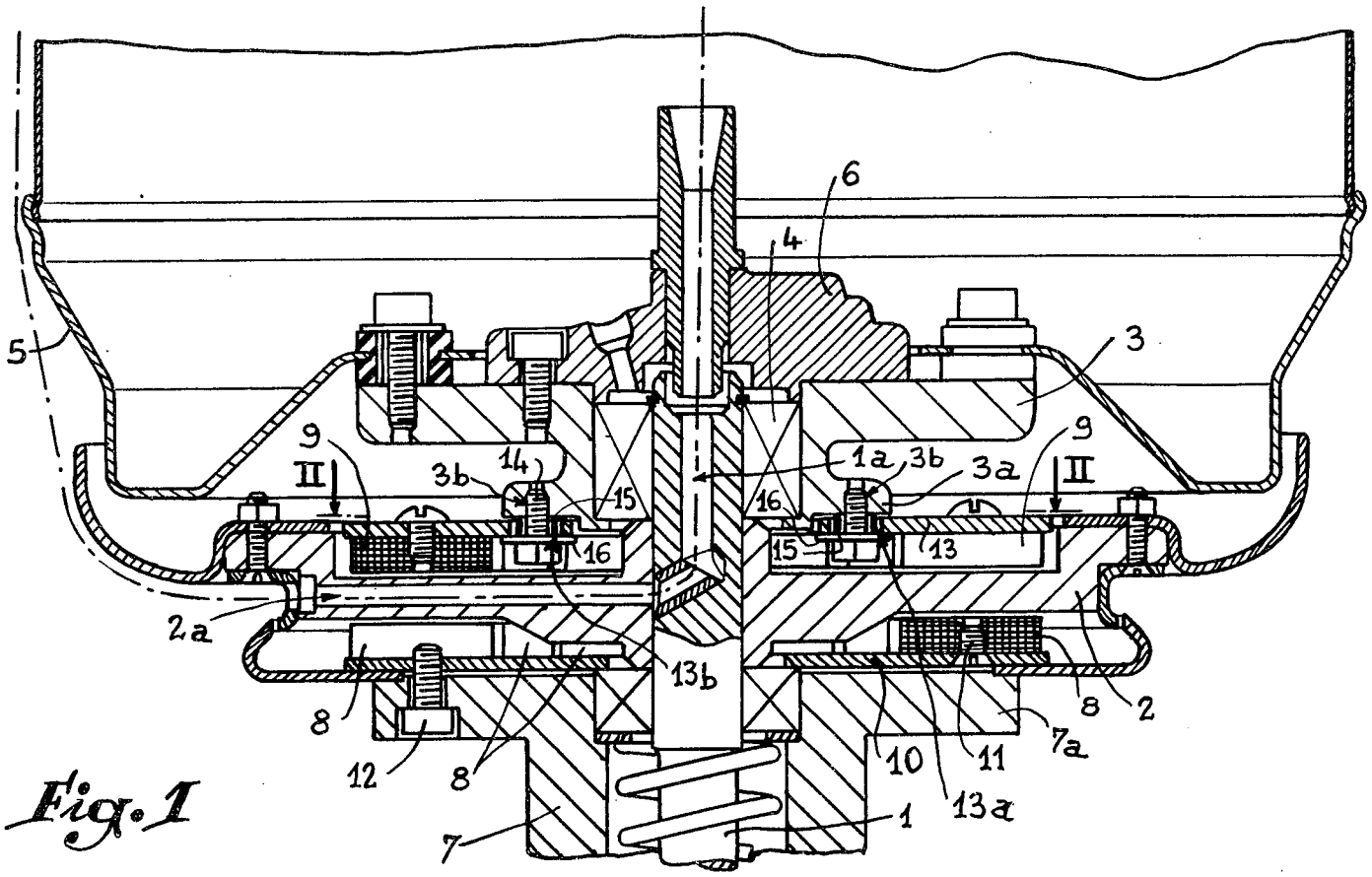
FIG. 1 is a fragmental longitudinal section showing the essential parts of a double twist spindle device according to a first embodiment of the invention.

Referring to FIG. 1 reference numeral 1 designates the shaft or spindle proper which is rotated by any conventional means not illustrated, such as for instance an individual motor or a pulley driven by a belt. The upper portion of spindle 1 has an axial bore 1*a* which communicates with a radial perforation 2*a* formed in an outlet disc 2 rigidly mounted on spindle 1, as for instance as a force fit, in order to rotate therewith. A bobbin supporting plate 3 is rotatably mounted on spindle 1 above disc 2 by means of frictionless bearings 4. This plate carries a cylindrical metallic box or can 5 adapted to surround the supply bobbin which rests on a base 6 secured to plate 3.

As hitherto described the construction is quite conventional and is not therefore to be more elaborately explained. When spindle 1 rotates, plate 3 is retained against rotation by appropriate means together with the supply bobbin which it supports. The yarn drawn from the latter enters the upper end of spindle 1 and issues from the bore 1*a* thereof through the radial perforation 2*a* of the outlet disc 2 which rotates with the spindle, thus imparting a first twist to the yarn. The latter forms a rotating balloon around can 5 to reach the conventional eyelet disposed axially above the spindle device, the rotation of the balloon with respect to the non-rotating eyelet and to the subsequent guiding and re-winding members realizing the second twist.

As aforesaid the problem in such a double twist spindle is that the bobbin supporting plate 3 should be maintained at standstill on spindle 1 in spite of the rotation of the latter, without interfering with the balloon which, starting from the bore 1*a* of spindle 1, surrounds the said can 5 in such manner that no physical retaining member may be disposed between the plate and any non-rotating part external to the balloon.

Figure 2:
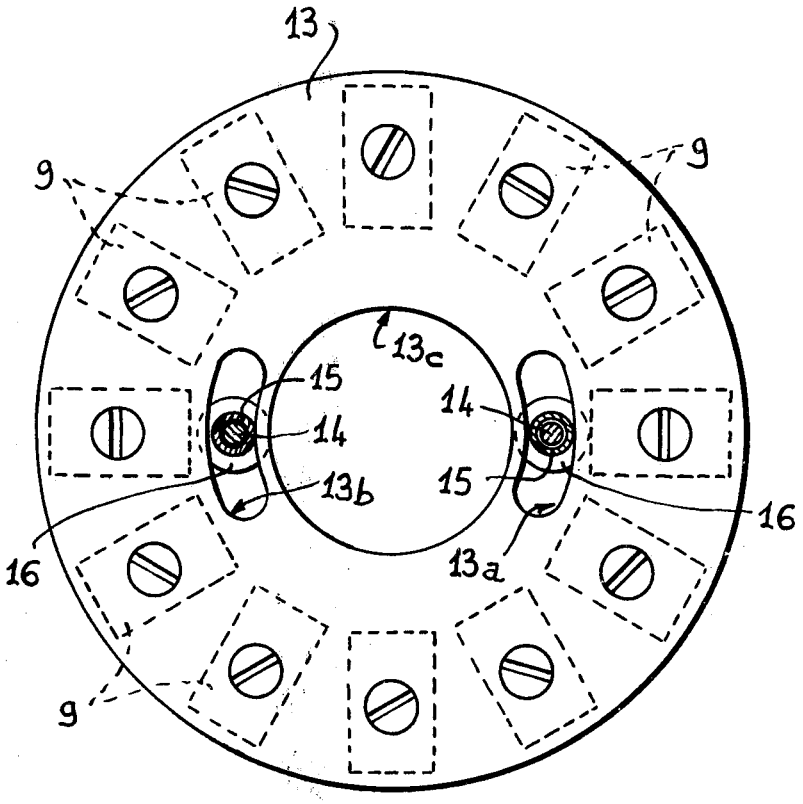
FIG. 2 is croos-section taken along line II-II of FIG. 1, this view only showing the crown with its row of magnets, its notches and the screw and sleeve units which are passed therethrough.

In the embodiment of FIGS. 1 and 2 the base 7 of the spindle device is formed with an upper flange 7*a* which carries a circular row of permanent magnets 8 of alternate polarity adapted to cooperate through disc 2 with magnets 9 also disposed with alternate polarity in a circular row carried by the bobbin supporting plate 3. Magnets 8 are mounted on the upper side of an annular plate 10 by means of screws 11, the circular plate 10 being in turn secured by screws 12 to flange 7*a* which constitutes the retaining member in the arrangement.

Magnets 9 are fixed by screws to the lower side of a flat crown 13 (FIGS. 1 and 2) formed with two diametrically opposed arcuate notches 13*a*, 13*b* concentric to the inner periphery 13*c* of the crown. A screw 14 carrying a loose sleeve 15 passes through each of these notches and is screwed into a tapped hole 3*b* formed in a lower flange-like portion 3*a* of the bobbin supporting plate 3, these holes 3*b* being diametrically opposed to each other. It is to be noted that the holes 3*b* are so dimensioned that the heads of the screws and the flat whashers 16 associated to these heads do not clamp crown 13 against flange 3*a* and also leave sleeves 15 free to rotate, in such manner that finally the unit formed of magnets 9 and of crown 13 may rotate through a limited angle about the general axis of the spindle device with respect to the bobbin supporting plate 3, as this may be clearly seen from FIG. 2, remembering that screws 14 are rigidly secured to plate 3.

The circular plate 10 and the crown 13 are preferably made of iron or soft steel in order to respectively form a common armature for magnets 8 or 9. As to disc 2, it should of course be made of a non-magnetic material so as not to interfere with the magnetic forces developped by the facing magnets.

In operation the slight frictional torque which appears between the rotating spindle 1 and the non-rotating bobbin supporting plate 3 has for its result that the screws 14 and their loose sleeves 15 are in abutment against the end of each of the arcuate notches 13*a*, 13*b* which corresponds to the direction of rotation of the spindle. Assuming the latter rotates clockwise as seen from above (i.e. as it would appear in FIG. 2), units 14-15 are respectively against the lower end of notch 13*a* and against the upper end of notch 13*b*. If the frictional torque is slight, as is the case under normal conditions, the North and South magnets 9 of the upper row are almost respectively in front of the South and North magnets 8.

When the frictional torque increases, the upper row (magnets 9) becomes progressively angularly displaced in the clockwise direction with respect to the lower row (magnets 8) and this angular displacement develops increasing attractive and repulsive horizontal resultants of torques which retain the lower row and therefore the bobbin supporting plate 3. If however, as sometimes occurs, an excessive frictional torque appears during a short time, the angular displacement may reach a value substantially equal to the angular pitch of the successive magnets in the rows, in which case the horizontal forces exerted between the rows are reversed. But while in known spindle devices equipped with retaining magnets this would cause sudden clockwise acceleration of the bobbin supporting plate and consequently continuous rotation thereof with the spindle, with the present arrangement this reversal of the magnetic forces only displaces crown 13 with respect to screws 14 and sleeves 15 which come to bear against the other end of each of notches 13*a*, 13*b*. This relatively quick displacement of the upper row of magnets with respect to the lower row has for its result that the bobbin supporting plate is not accelerated and that the system may find another state of equilibrium if the excessive torque has disappeared, the screw and sleeve units 14-15 progressively returning towards the clockwise ends of notches 13*a*, 13*b*. If the excessive torque persists, the upper row (crown 13 and magnets 9) may again rotate through one pitch with respect to the screw and sleeve units, and so on, the accelerating effect of the magnetic forces on the bobbin supporting plate being each time avoided.

Of course this operation implies that the angular extent of notches 13*a*, 13*b* is somewhat higher than the angular pitch of the successive magnets 8 and 9 in their respective rows and also that the moment of inertia of the unit formed by crown 13 and magnets 9 is lower than the moment of inertia of plate 3 with the supply bobbin which it supports.

In the embodiment of FIGS. 3 and 4 the arcuate notches 13*a*, 13*b* of FIGS. 1 and 2 are replaced by mere circular holes 13*d*. The lower side 3*c* of the flange-like portion 3*a* of plate 3 has been machined to create a flat annular shoulder 3*d* having an inner diameter somewhat lower than the diameter of the inner periphery 13*c* of the magnet supporting crown 13. Sleeves 15 have a length which is substantially greater than the thickness of crown 13; they are no more loose on screws 14, but form tubular stays clamped between washers 16 and shoulder 13*d*. With such an arrangement crown 13 is no more angularly displaceable with respect to plate 3, but it only rests by gravity on washers 13 and may freely rise through the extent permitted by the presence of shoulder 13*d*, i.e. by the difference between the length of sleeves 15 and the thickness of the said crown.

Here again under normal operating conditions the North and South magnets 9 of the upper row are respectively almost in front of the South and North magnets 8 of the lower row. Also if the frictional torque between the spindle and the bobbin supporting plate increases, there appears an angular clockwise displacement of the upper row with respect to the lower one. But in the case of an excessive torque, when the angular displacement becomes substantially equal to the angular pitch of the successive magnets in the rows, each North or South magnet of the upper row (magnets 9 and crown 13) comes respectively opposite a similar polarity magnet of the lower row (magnets 8 and plate 10) and the vertically directed resultant of the repulsive forces is such that magnets 9 are raised together with crown 13 (position of FIG. 4). The distance between the facing magnets is thus increased and the intensity of the magnetic forces is therefore decreased. The result is that the undesirable accelerating action exerted on crown 13 (and of course on the bobbin supporting plate 3) is substantially reduced. Here again the system may find a new state of equilibrium if the excessive torque has disappeared in the meantime as is very often the case, crown 13 being returned by gravity to its normal operating position of FIG. 3 once the vertically directed resultant of the magnetic forces has disappeared.

It is to be noted that the respective roles of the magnet rows could be exchanged in the sense that the magnets 9 of the upper row could be rigidly fixed to the underside of the bobbin supporting plate 3, while the circular plate 10 on which the magnets 8 of the lower row are mounted would be either rotatable through a limited angle with respect of the flange-like portion *7a*, or vertically movable with respect thereto as for instance against the action of relatively light supporting springs.

What I claim is:

1. In a double twist spindle device having a base member supporting a hollow spindle for rotation with respect to the base member, the spindle having a radially disposed disc adjacent to the base member and the disc having a radial yarn opening communicating into the spindle, and the device having a bobbin support member journaled to and surrounding the spindle on the other side of the disc from the base member, the spindle being rotatable about its axis within the bobbin support member, improved means for opposing rotation of the bobbin support member with respect to the base member comprising:

(a) a first plate and a second plate, the plates being radially disposed with respect to the spindle and being respectively located on opposite sides of said disc and spaced from the disc and the spindle;

(b) an annular series of magnets mounted on each plate concentric with the spindle, the magnets in each series having poles facing the magnets in the opposite series across the disc, and the poles of the magnets alternating in polarity circumferentially about the series;

(c) means for fixing one of said plates to one of said members; and (d) means for supporting the other of said plates on the other of said members, including means operative when the magnetic forces between the opposite series of magnets are attractive to transmit from said other plate to said other member torque directed to oppose rotation of said bobbin support member about said base member, and including means operative when the forces between the opposite series of magnets are repulsive to displace said other plate relative to said other member in a direction to decrease the repulsion forces between the magnets of the two series.

2. The double twist spindle device as claimed in claim 1, wherein said means for supporting the other of said plates on the other of said members further comprises means for supporting said other plate rotatably with respect to said axis on said other member, and means operative between said other plate and other member to limit the angle through which one can rotate relative to the other.

3. The double twist spindle device as claimed in claim 2, wherein said other plate has plural annularly arcuate notches therethrough, and said supporting means includes fasteners extending through said arcuate notches and fixed to said other member.

4. The double twist spindle device as claimed in claim 3, wherein the annular extent of each arcuate notch is greater than the circumferential separation between poles of alternate polarity.

5. The double twist spindle device as claimed in claim 4, wherein the moment of inertia of said other plate and the series of magnets mounted thereon is smaller than the moment of inertia of the bobbin support member in its loaded state.

6. The double twist spindle device as claimed in claim 1, wherein said means for supporting the other of said plates on the other of said members comprises means for supporting said other plate so that it is free to reciprocate axially to a limited extent but fixed against rotation relative to said other member whereby said other plate moves axially toward said one plate when the magnetic forces are attractive and away from said one plate when the magnetic forces are repulsive.

7. The double twist spindle device as claimed in claim 6, wherein the spindle axis is substantially vertical and said other plate is oriented above said one plate so that it is urged toward said one plate by gravity.

* * * * *